US006334698B1

(12) United States Patent
Jackson

(10) Patent No.: US 6,334,698 B1
(45) Date of Patent: Jan. 1, 2002

(54) FLASHLIGHT STABILIZING DEVICE

(76) Inventor: Joseph D. Jackson, P.O. Box 943, Portsmouth, NH (US) 03802

( * ) Notice: Subject to any disclaimer, the term of this patent is extended or adjusted under 35 U.S.C. 154(b) by 0 days.

(21) Appl. No.: 09/558,097

(22) Filed: Apr. 25, 2000

Related U.S. Application Data

(60) Provisional application No. 60/134,001, filed on May 13, 1999.

(51) Int. Cl.[7] ..... F21L 4/04

(52) U.S. Cl. ..... 362/200; 362/189; 362/208; 362/389

(58) Field of Search ..... 362/200, 189, 362/208, 186, 389

(56) References Cited

U.S. PATENT DOCUMENTS 5,165,782 A * 11/1992 Maglica et al. ..... 362/208

* cited by examiner

*Primary Examiner*—Sandra O'Shea
*Assistant Examiner*—Bertrand Zeade

(57) ABSTRACT

The device prevents the undesired movement of a flashlight. It is fabricated from elastic material. It may be installed on many different models of flashlight. It does not interfere with the normal use or maintenance of the flashlight. It may be installed or removed without complex manipulation or the use of tools.

2 Claims, 3 Drawing Sheets

FLASHLIGHT STABILIZING DEVICE

This Application claims benefit of Prov. No. 60/134,001 May 13, 1999.

FIELD OF THE INVENTION

The present invention relates to a stabilizing device to prevent the undesired movement of a flashlight. More specifically, the present invention relates to a device to prevent rolling, sliding or other displacement when the flashlight is placed on a inclined, rough or vibrating surface.

PRIOR ART

In using a flashlight it is frequently desirable to lay the flashlight down on some convenient surface. If that surface is not flat, smooth and motionless there is a tendency for the flashlight to become displaced, depriving the user of a view of the object of interest. This loss of perception may be critical for police, firemen and other emergency service personnel.

Numerous devices have been designed to address this problem. Flashlights have been designed with peripherally multifaceted lens caps. Others have been supplied with stabilizing devices that may be attached to the lens cap. Still others have been equipped with stands or brackets. None of these devices have been completely satisfactory as they have proved to be of limited effectiveness or have significantly interfered with the normal use or maintenance of the flashlight. Usually, these devices are an integral component of the flashlight for which they are designed and are usable on only one model of flashlight.

SUMMARY OF THE INVENTION

The principal object of this invention is to provide a device for preventing the undesired movement of a flashlight.

It is also an object of this invention to provide such a device which is of simple and inexpensive construction.

Another object is to provide such a device that does not interfere with the normal use and maintenance of the flashlight.

A further object is to provide a device that is usable on many models of flashlight.

The foregoing objects can be accomplished by providing a flashlight stabilizing device fabricated from elastic material, having an internal opening sized to fit the barrel of a flashlight and an external geometry such as to resist rolling or sliding.

DETAILED DESCRIPTION

Figure 1:
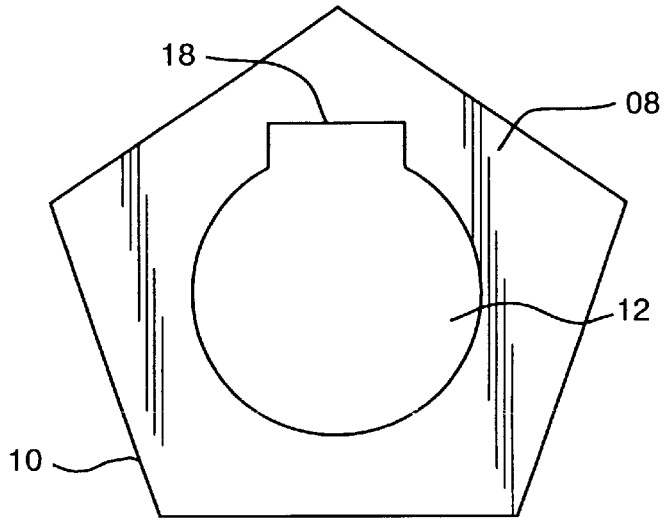
FIG. 1 is a plain view of the device, showing it's general form.
Figure 2:
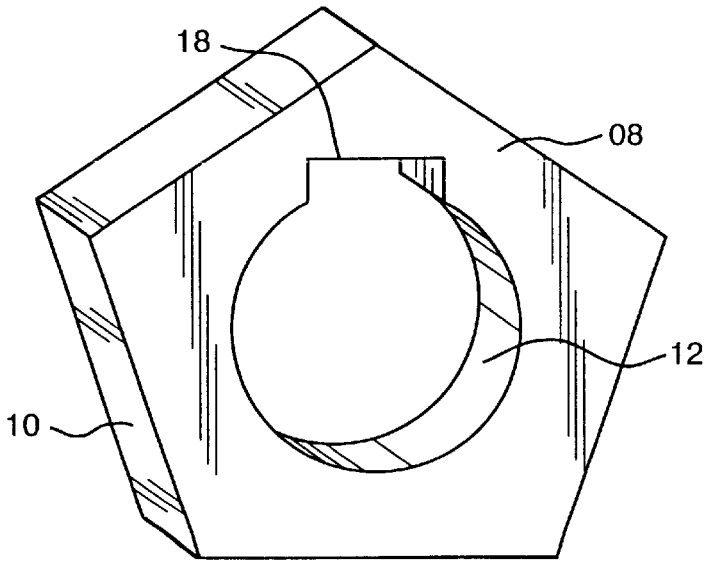
FIG. 2 is a perspective view of the device.

The preferred flashlight stabilizing device in accordance with the present invention, as shown in FIG. 1, FIG. 2 and FIG. 3 is a fabrication of elastic material 8 having an internal opening 12 of an appropriate shape and size to firmly grip a flashlight barrel by it's elastic contraction and having an external geometry 10 providing resistance to rolling and sliding, said flashlight stabilizing device is interchangeable for different models of flashlight having the same size of battery.

In this preferred embodiment the material from which the device is fabricated 8 is Chloroprene rubber. However, other materials may be used such as Buna-N, Polyurathane, Vinyl or various other rubber and plastic materials.

Figure 3A:
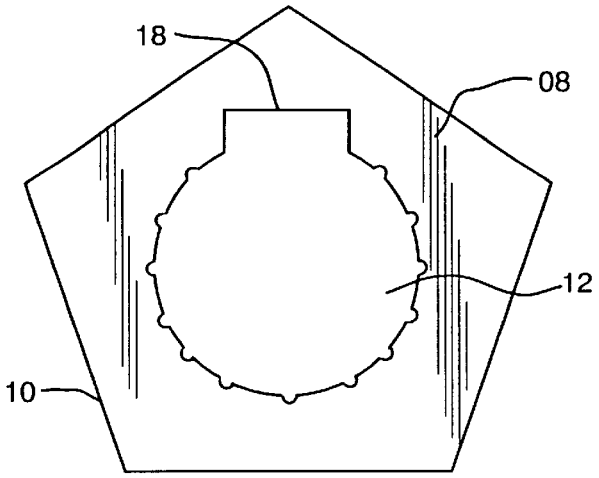
FIGS. 3A, 3B, and 3C show means whereby the device is modified for use on flashlights of different body size.
Figure 3B:
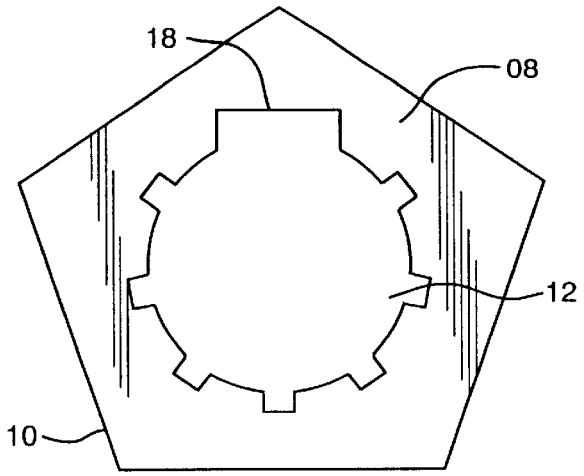
Figure 3C:
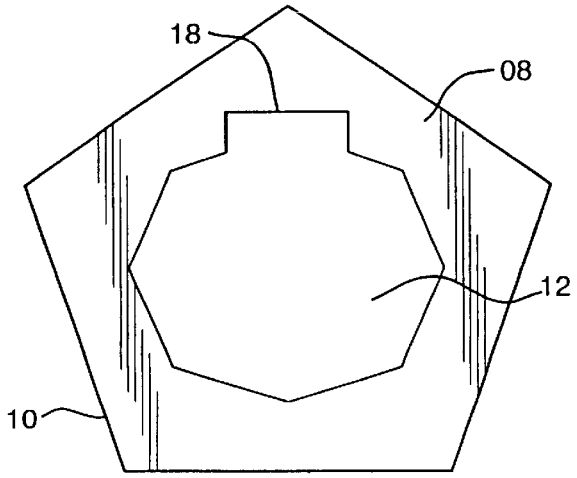

Also, in the preferred embodiment the internal opening 12 while being substantially circular in shape may be modified as shown in FIG. 3*a*, FIG. 3*b* and FIG. 3*c* to accommodate variations in the barrel diameter of different models of flashlight. The internal opening 12 may also have a notch 18 to permit clearance for the flashlight switch assembly and to correctly index the device on the flashlight barrel.

In this preferred embodiment the external geometry 10 is that of a pentagon. However, in other embodiments the external geometry may be of other shapes such as hexagon, square, triangle or other shape providing resistance to rolling or sliding.

The preferred method of fabrication is by molding or by die cutting from flat stock. Fabrication may also be by sawing and drilling.

Figure 4:
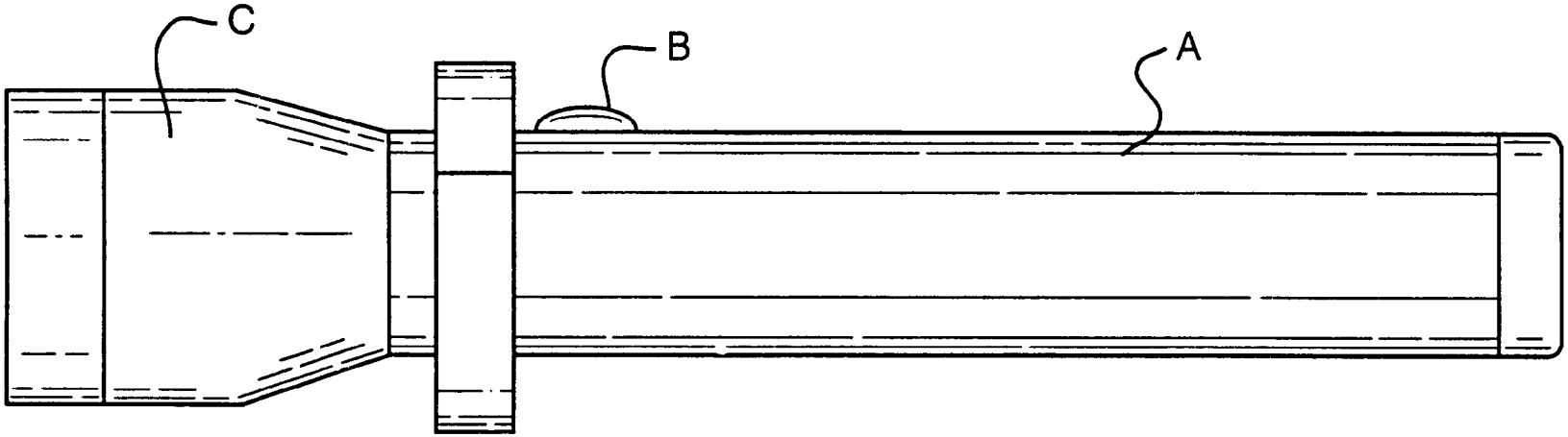
FIG. 4 shows the device, correctly installed on a typical flashlight body.

The device is installed, as shown in FIG. 4, by manually pressing it onto the flashlight barrel A to a position between the on/off switch B and the head C of the flashlight.

The device may be removed from the flashlight by manually pressing it off in a manner in reverse of it's installation.

An important feature of the device is that it may be installed or removed without complex manipulation or the use of tools.

A further significant feature of the device is that it may be installed on many different models of flashlight.

The foregoing description of the preferred embodiment of the invention is not intended to be exhaustive or to limit the invention to the precise form disclosed. Many modifications and variations are possible in light of the above disclosure. It is intended that the scope of the invention not be limited by this detailed description, but by the claims appended hereto.

I claim:

1. A flashlight stabilizing device comprising: a fabrication of elastic material, having an interior opening of an appropriate shape and size to firmly grip a flashlight barrel by elastic contraction, and having an external geometry providing resistance to rolling and sliding, said flashlight stabilizing device is interchangeable for different models of flashlight having the same size of battery.

2. The device of claim 1 fabricated from chloroprene rubber.

* * * * *